US009578947B2

(12) United States Patent
Wan

(10) Patent No.: US 9,578,947 B2
(45) Date of Patent: Feb. 28, 2017

(54) NAIL LAMP

(71) Applicant: LumiTech Int'l Inc., Taoyuan (TW)

(72) Inventor: Kevin Wan, Taoyuan (TW)

( * ) Notice: Subject to any disclaimer, the term of this patent is extended or adjusted under 35 U.S.C. 154(b) by 210 days.

(21) Appl. No.: 14/601,916

(22) Filed: Jan. 21, 2015

(65) Prior Publication Data

US 2016/0095410 A1 Apr. 7, 2016

(30) Foreign Application Priority Data

Oct. 3, 2014 (TW) ..... 103217729 U

(51) Int. Cl.
*A45D 29/00* (2006.01)

(52) U.S. Cl.
CPC ..... *A45D 29/00* (2013.01); *A45D 2200/205* (2013.01)

(58) Field of Classification Search
CPC .. A45D 29/00; A45D 44/00; A45D 2200/205; A45D 2029/008; A45D 29/11; A45D 29/18; A45D 29/20; A45D 29/17; F21V 23/00; F21V 33/00; F21V 33/0004; F21V 33/008; F21V 99/00
See application file for complete search history.

(56) References Cited

U.S. PATENT DOCUMENTS

| | | | | |
|---|---|---|---|---|
| 8,450,705 | B1 * | 5/2013 | Chen | F26B 3/28 250/492.1 |
| 8,739,431 | B2 * | 6/2014 | Cheng | A45D 29/00 132/73 |
| 2013/0161531 | A1 * | 6/2013 | Haile | B01J 19/123 250/455.11 |
| 2015/0136164 | A1 * | 5/2015 | Yi | A45D 29/00 132/200 |
| 2015/0182001 | A1 * | 7/2015 | Yi | A45D 29/00 132/200 |
| 2015/0265027 | A1 * | 9/2015 | Wan | A45D 44/00 34/275 |
| 2016/0089694 | A1 * | 3/2016 | Jih | A45D 29/00 34/202 |
| 2016/0166041 | A1 * | 6/2016 | Duru | A45D 29/00 250/453.11 |

* cited by examiner

*Primary Examiner* — Bao Q Truong

(57) ABSTRACT

A nail lamp includes an inner casing including an inner shell and an inner chamber enclosed by the inner shell, wherein the inner chamber has an opening; a light emitting module disposed on an inner surface of the inner shell and facing the inner chamber; a control module disposed on the inner shell and electrically connected with the light emitting module; an outer housing hooding the inner casing, revealing the opening; and a touchscreen module or an ordinary screen module disposed on the outer housing and electrically connected with the control module with the touchscreen or screen thereof exposed to the exterior. An option menu is programmed in the operating interface of the touchscreen module beforehand. The user directly uses her/his finger to select an option from the option menu. The touchscreen or ordinary screen can further display the information the related parties intend to present.

20 Claims, 12 Drawing Sheets

NAIL LAMP

BACKGROUND OF THE INVENTION

1. Field of the Invention

The present invention relates to a nail lamp, particularly to a nail lamp, which can cure the nail gel and display information for the user simultaneously.

2. Description of the Prior Art

Nail art has prevailed in recent years. The modern nail art usually coats nails with different colors of resins to provide the nails with the brilliance and chrominance. Sometimes, the nail art design is diversified via sticking decorative platelets on the nails. Normally, a nail lamp is used to illuminate the nails so as to fast cure the resins or glues on the nails.

The conventional nail lamp has a plurality of press keys disposed on the top front region thereof. The press keys are connected with the control circuit and used to control the operation of the lamp panel inside the nail lamp. The press keys respectively correspond to different operation durations of the lamp panel, such as 10 seconds, 30 seconds, 60 seconds and 90 seconds. Each press key includes a keycap and a link lever connecting the keycap and the control circuit. While the user presses a press key, the control circuit controls the lamp panel to operate for a duration preset for the press key. The number of options is limited by the number of press keys. For example, the abovementioned conventional nail lamp only has four options of operation durations, i.e. 10 seconds, 30 seconds, 60 seconds and 90 seconds. While the number of options is required to increase, more keycaps and link levers must be installed in the conventional nail lamp, which would complicate fabrication and increase the probability of damage.

SUMMARY OF THE INVENTION

One objective of the present invention is to provide a nail lamp, which has a touchscreen module, wherein a plurality of options of operation durations of the light source is programmed in the operating interface, whereby the user can directly use his finger to select an option on the operating interface, wherefore the present invention is exempted from the keycaps and link levers of the conventional nail lamp and has diversified applications.

Another objective of the present invention is to provide a nail lamp, which has a touchscreen or an ordinary screen, wherein the beauty industry and the advertisement industry can use a communication module to transmit their information to the nail lamp and display the information on the touchscreen or the ordinary screen, whereby the manicurists can periodically or aperiodically receive nail art-related information, and whereby the customers can watch videos or read articles displayed on the touchscreen or the ordinary screen to enjoy themselves during nail manicuring and gel curing.

To achieve the abovementioned objectives, one embodiment of the present invention proposes a nail lamp, which includes an inner casing including an inner shell and an inner chamber enclosed by the inner shell, wherein the inner chamber has at least one opening, and wherein the inner shell has an inner surface and an outer surface, and the inner surface faces the inner chamber; a light emitting module disposed on the inner surface of the inner shell; at least one control module disposed on the inner shell and electrically connected with the light emitting module; an outer housing hooding the inner casing, revealing the opening; and a touchscreen module disposed on outer housing, having an operating interface exposed to the exterior and electrically connected with the control module.

Another embodiment of the present invention also proposes a nail lamp, which includes an inner casing including an inner shell and an inner chamber enclosed by the inner shell, wherein the inner chamber has at least one opening, and wherein the inner shell has an inner surface and an outer surface, and the inner surface faces the inner chamber; a light emitting module disposed on the inner surface of the inner shell; a control module disposed on the inner shell and electrically connected with the light emitting module; an outer housing hooding the inner casing, revealing the opening; a screen module disposed on outer housing and electrically connected with the control module; and a communication module electrically connected with the control module, wherein the control module receives information through the communication module and displays the information on the screen module.

DESCRIPTION OF THE PREFERRED EMBODIMENT

The present invention will be described in detail with embodiments below. However, these embodiments are only to exemplify the present invention but not to limit the scope of the present invention.

Figure 1:
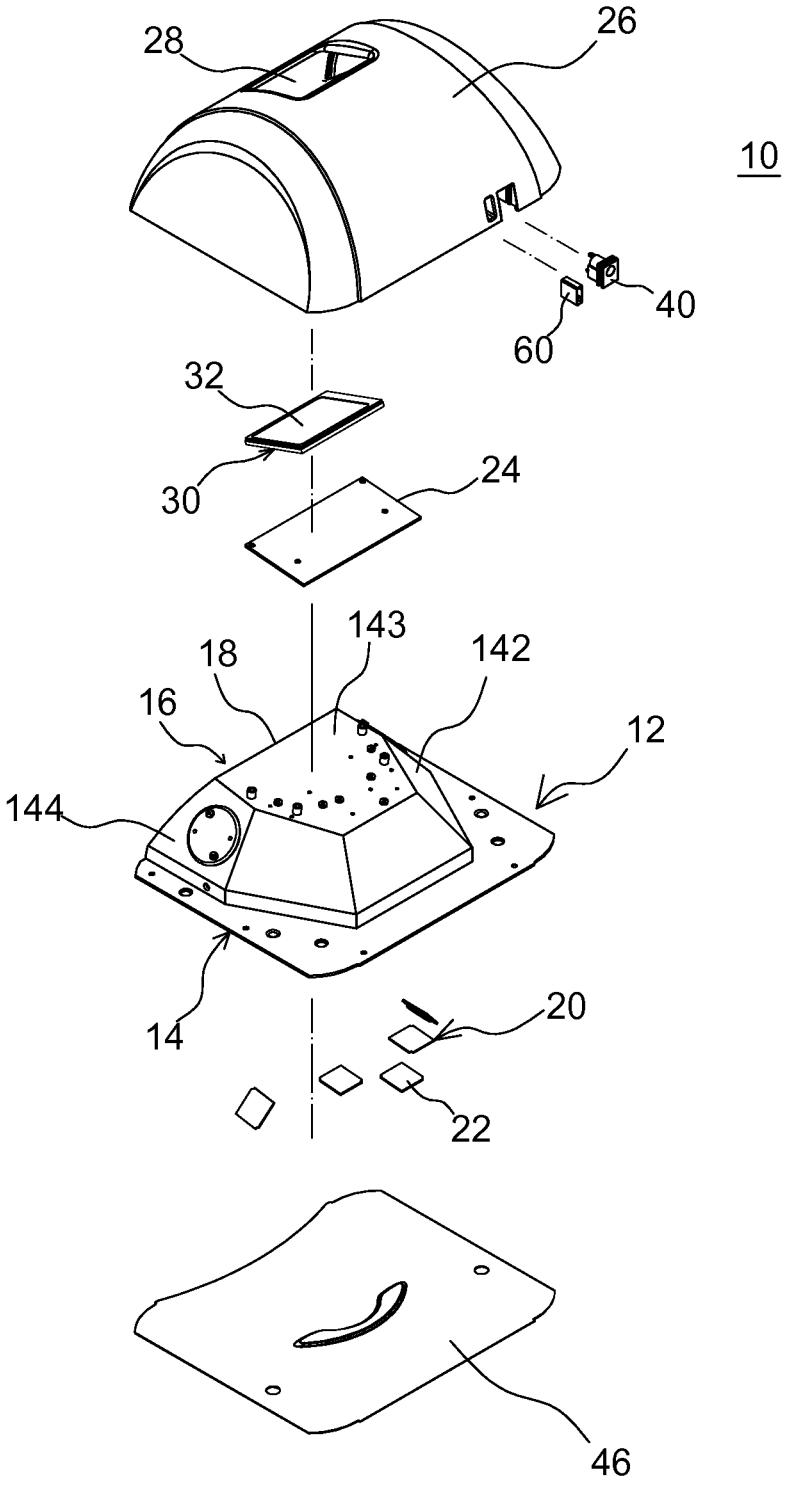
FIG. 1 is an exploded view schematically showing a nail lamp according to a first embodiment of the present invention.
Figure 2:
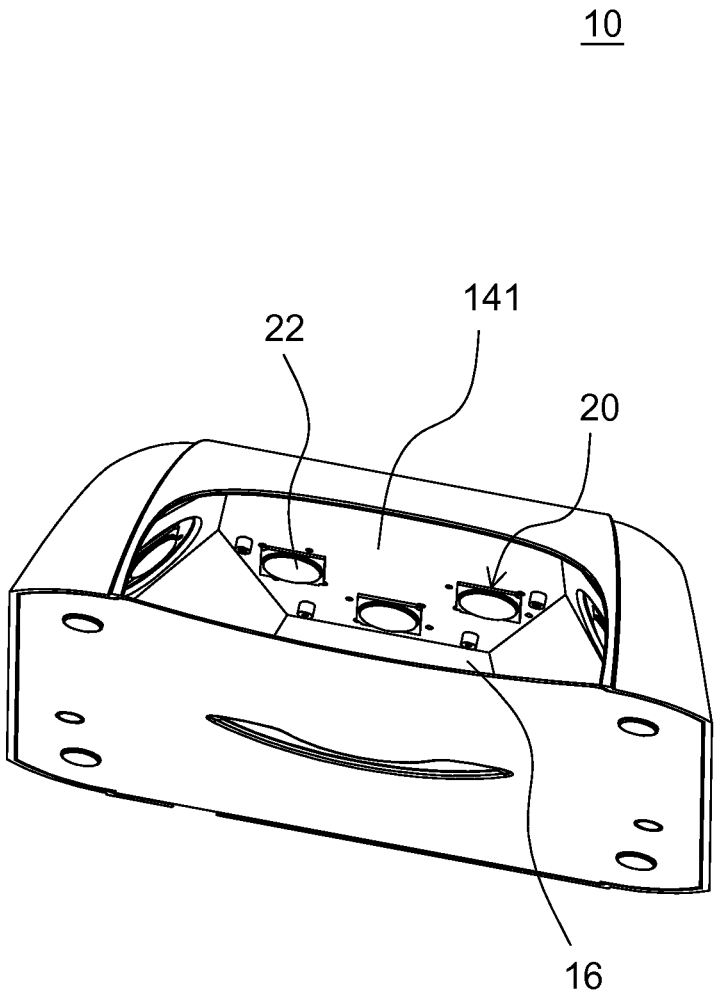
FIG. 2 schematically shows the structure of the nail lamp according to the first embodiment of the present invention.

FIG. 1 is an exploded view schematically showing a nail lamp according to a first embodiment of the present invention. As shown in FIG. 1, the nail lamp 10 includes an inner casing 12, a light emitting module 20, a control module 24, an outer housing 26 and a touchscreen module 30. The inner casing 12 includes an inner shell 14 and an inner chamber 16 enclosed by the inner shell 14. The inner chamber 16 has an opening 18. Refer to FIG. 2 also. The inner shell 14 has an inner surface 141 and an outer surface 142, and the inner surface 141 faces the inner chamber 16. In one embodiment, the inner shell 14 has a planar region 143 and a side region 144 extending downward from the left, right and rear edges of the planar region 143. The inner shell 14 is made of a metallic material or a plastic material. The inner surface 141 (shown in FIG. 2) of the inner shell 14 is a reflective surface.

As shown in FIG. 1 and FIG. 2, the light emitting module 20 is disposed on the inner surface 141 of the inner shell 14. In one embodiment, the light emitting module 20 includes a plurality of LED (Light Emitting Diode) modules 22 distributed on the inner surface 141 of the inner shell 14 and emitting light to the inner chamber 16. In one embodiment, the light emitting module 20 includes five LED modules 22. Three of the LED modules 22 are disposed on inner surface 141 of the planar region 142 of the inner shell 14. The other two LED modules 22 are respectively disposed on the two opposite inner surfaces 141 of the side region 144. However, the present invention does not limit that the LED modules 22 must have the abovementioned configuration. In one embodiment, the inner shell 14 is designed to have an arc shape.

Figure 3:
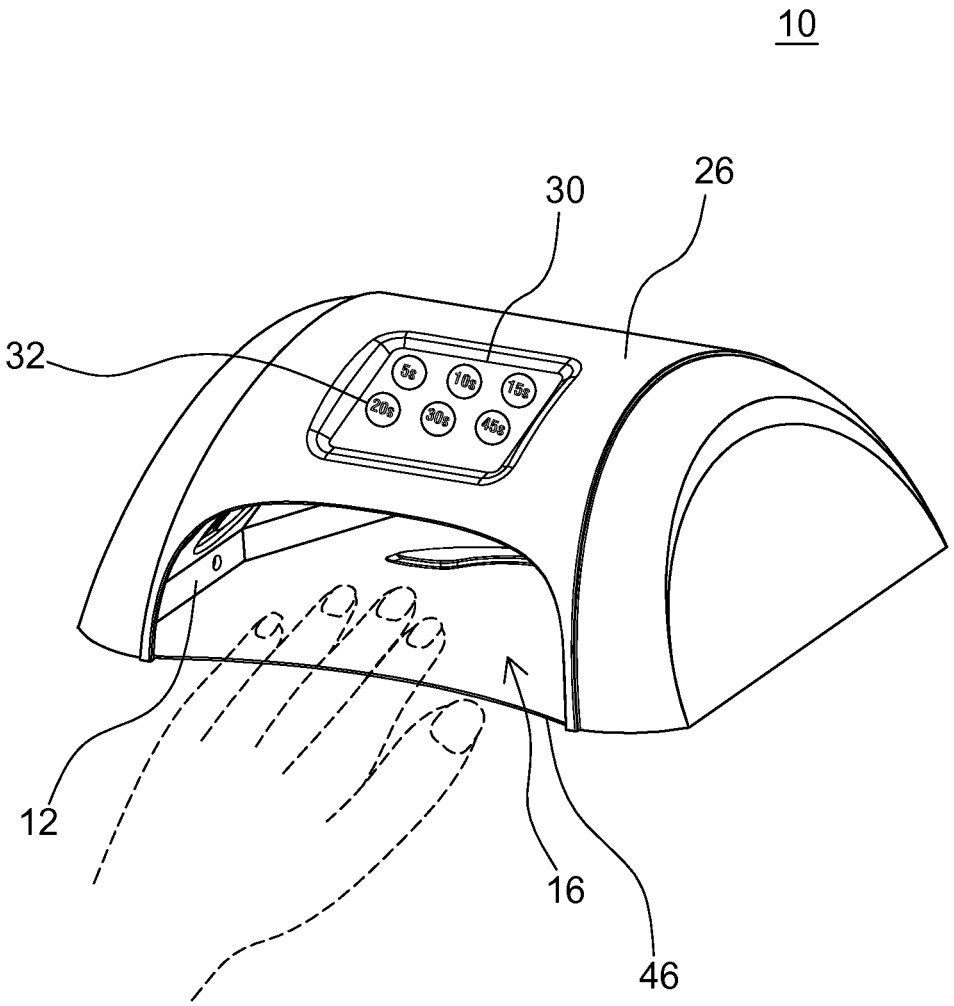
FIG. 3 schematically shows the application of a nail lamp according to one embodiment of the present invention.

As shown in FIG. 1, the control module 24 is disposed on the outer surface 142 of the planar region 142 of the inner shell 14 and electrically connected with the light emitting module 20 to control the plurality of LED modules 22 to emit light. As shown in FIG. 3, the outer housing 26 hoods the inner casing 12 but reveals the opening 18 (shown in FIG. 1) of the inner chamber 16. The front side of the outer housing 26 has a hole 28. As shown in FIG. 1 and FIG. 3, the touchscreen module 30 is disposed in the hole 28 with an operating interface 32 thereof being exposed. The touchscreen module 30 is electrically connected with the control module 24, whereby the user can use the operating interface 32 of the touchscreen module 30 to operate the nail lamp 10, and whereby the operating interface can display dynamic information (such as videos or advertisements) or static information (such as pictures or text) for the manicurist or the customer. A plurality of option items for selecting the operation durations (such as 5 seconds, 10 seconds, 15 seconds, 20 seconds, 30 seconds and 45 seconds) of the LED modules 22 is programmed to present on the operating interface 32, whereby the manicurist can select the desired operation duration of the LED modules 22 on the operating interface 32.

In one embodiment, the nail lamp 10 further includes a communication module (not shown in the drawings) and a memory module (not shown in the drawings), which are electrically connected with the control module 24. The communication module is a Bluetooth module, a WiFi module, a USB module, a WiMAX module or a combination thereof. Via the communication module and the memory module, the beauty industry and the advertisement industry can display their information on the touchscreen module 30. For example, the manufacturer of the nail lamp 10 established an advertisement information database and updates the database periodically. When turned on, the nail lamp 10 automatically retrieves advertisements from the advertisement information database through the communication module, stores the advertisements in the memory module, and displays the advertisements on the operating interface 32 of the touchscreen module 30.

Figure 4:
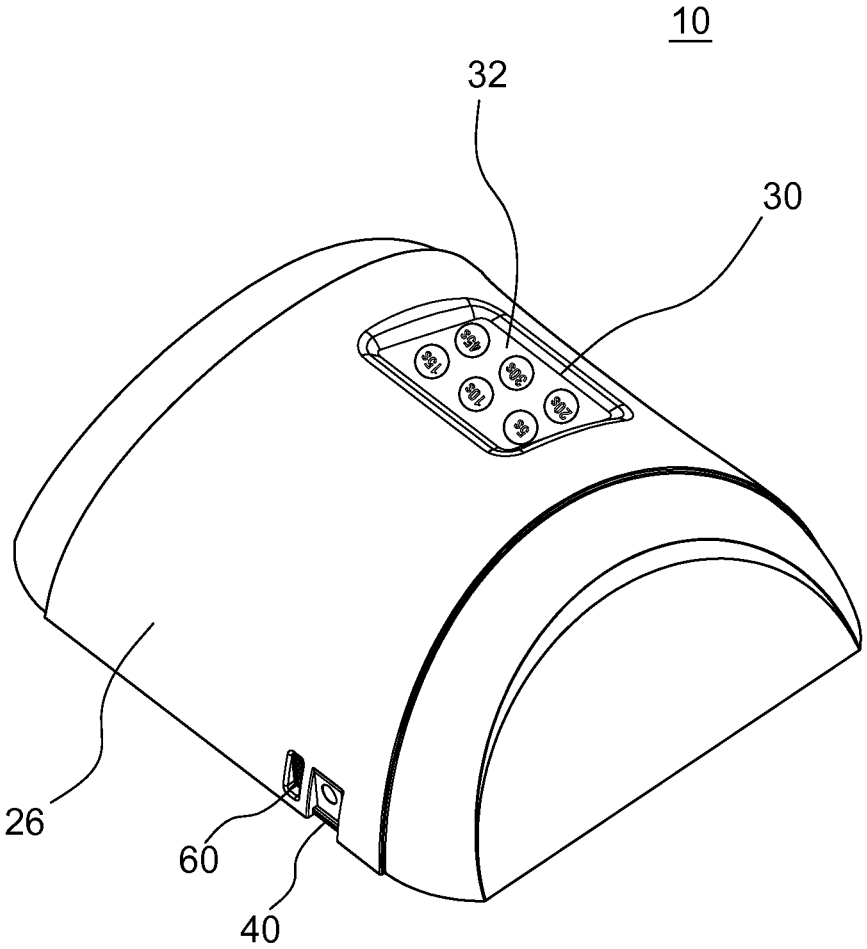
FIG. 4 schematically shows the structure of a nail lamp taken from another viewing angle according to one embodiment of the present invention.

As shown in FIG. 1 and FIG. 4, the nail lamp 10 further includes a DC (Direct Current) jack 40 and a USB connector 60, which are disposed on the rear side of the outer housing 26 and electrically connected with the control module 24. An external power source is connected with the DC jack 40 with a power cable to power the nail lamp 10. The nail artist may insert a USB flash drive into the UBS connector 60 to display the information, which the nail artist intends to present, on the operating interface 32 of the touchscreen module 30. Besides, the nail artist may display the information stored in the USB flash drive and the information stored in the memory module alternatingly.

In one embodiment, the control module 24 further includes a light emitting module control unit and a touchscreen module control unit. The light emitting module control unit is electrically connected with the light emitting module 20. The touchscreen module control unit is electrically connected with the touchscreen module 30. In one embodiment, the light emitting module control unit and the touchscreen control unit are integrated into a circuit module, as shown in FIG. 1. However, the present invention does not limit that the light emitting module control unit and the touchscreen control unit must be integrated into one circuit module. In another embodiment, the light emitting module control unit and the touchscreen control unit are independent units and fabricated into different circuit modules.

Figure 5:
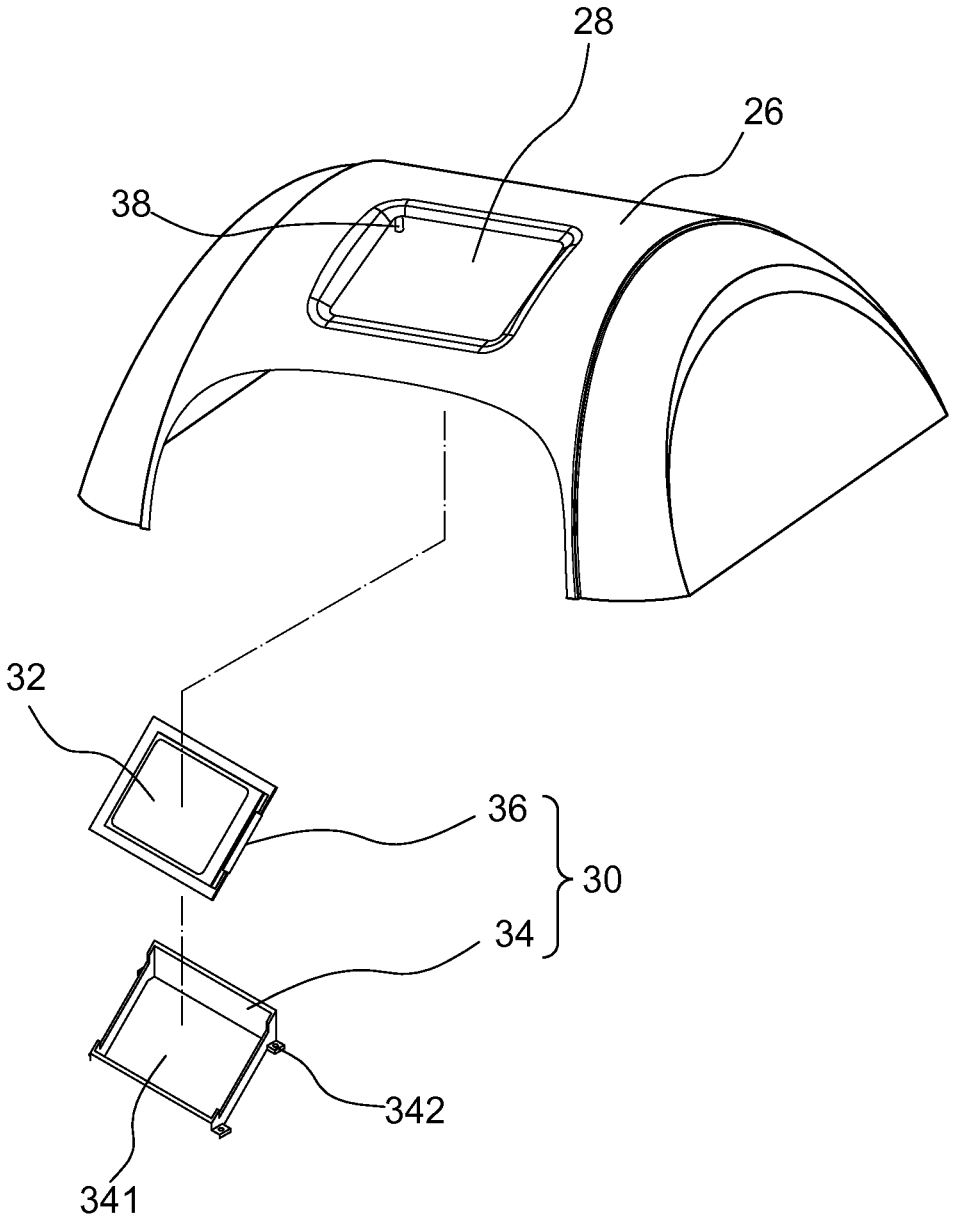
FIG. 5 is a partial exploded view schematically showing an outer housing and a touchscreen module of a nail lamp according to one embodiment of the present invention.

Refer to FIG. 5. In one embodiment, the touchscreen module 30 includes a bracket 34 and a touchscreen 36 fixedly installed in an accommodation space 341 of the bracket 34. A plurality of fixing members 342 is extended from two opposite sides of the bracket 34. A plurality of fixing pillars 38 is disposed corresponding to the fixing members 342 and installed on the inner surface of the outer housing 26 and along the hole 28. Each fixing pillar 38 has a threaded hole (not shown in the drawings). A plurality of screws (not shown in the drawings) is screwed through the fixing members 342 of the bracket 34 and into the threaded holes, whereby the bracket 34 is fastened to the rim of the hole 28 with the operating interface 32 of the touchscreen 36 being exposed. The hole 28 is formed on the front side or rear side of the outer housing 26. In other words, the touchscreen module 30 may be disposed on the front side or rear side of the outer housing 26 according to requirement.

Figure 6:
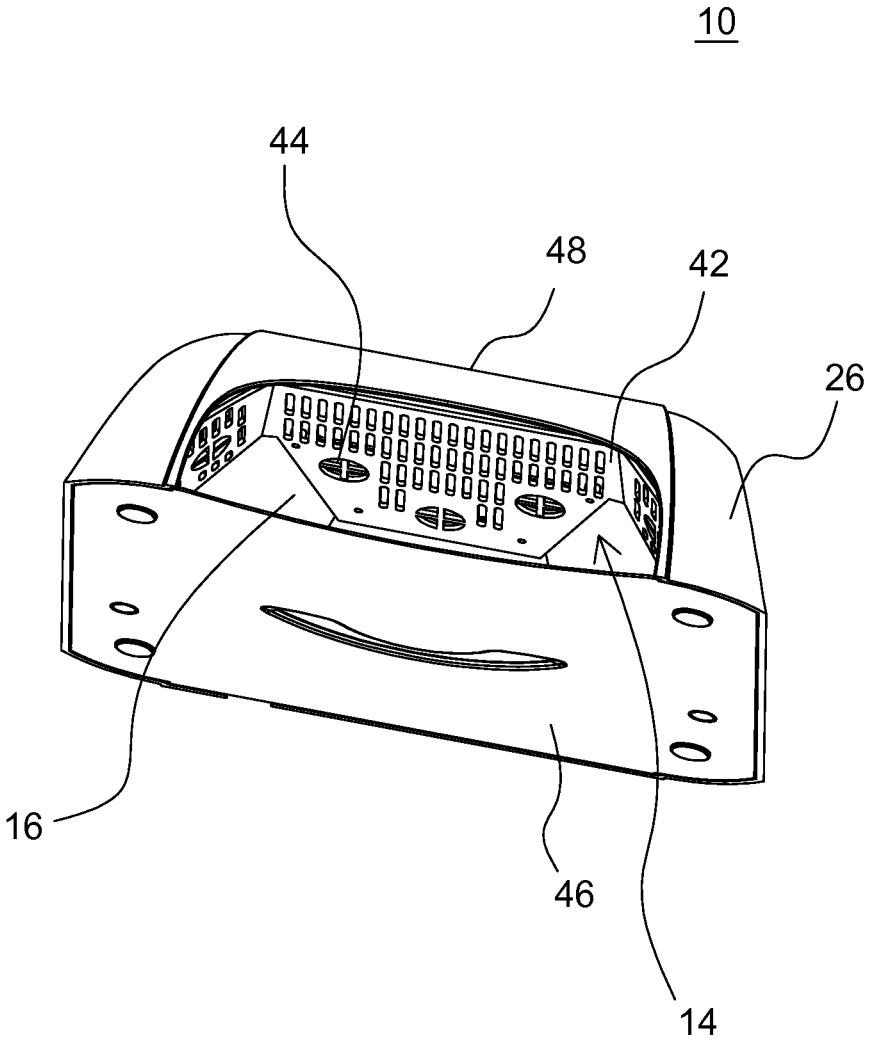
FIG. 6 schematically shows the structure of a nail lamp having a transparent thermal insulation cover according to another embodiment of the present invention.

Refer to FIG. 6. In one embodiment, the nail lamp 10 further includes a transparent thermal insulation cover 42 disposed below the inner shell 14, and the LED modules 22 (shown in FIG. 2) are interposed between the inner shell 14 and the transparent thermal insulation cover 42. The transparent thermal insulation cover 42 has a plurality of light holes 44 respectively corresponding to the LED modules 22, whereby the light emitted by the LED modules 22 passes through the light holes 44 to the inner chamber 16. While the customer reaches her/his hand into the inner chamber 16, the transparent thermal insulation cover 42 prevents her/his hand from touching the LED modules 22 lest the LED modules 22 be damaged. The transparent thermal insulation cover 42 also prevents the hand from being persistently illuminated by the light, except the nails. Refer to FIG. 1 and FIG. 3 again. In one embodiment, the nail lamp 10 further includes a bottom plate 46 disposed on the bottom of the inner casing 12 and assembled to the outer housing 26. The bottom plate 46 is normally made of a stainless steel. In one embodiment, the nail lamp 10 further includes speaker elements (not shown in the drawings) electrically connected with the control module 24; the outer housing 26 has a plurality of speaker holes (not shown in the drawings).

Figure 7:
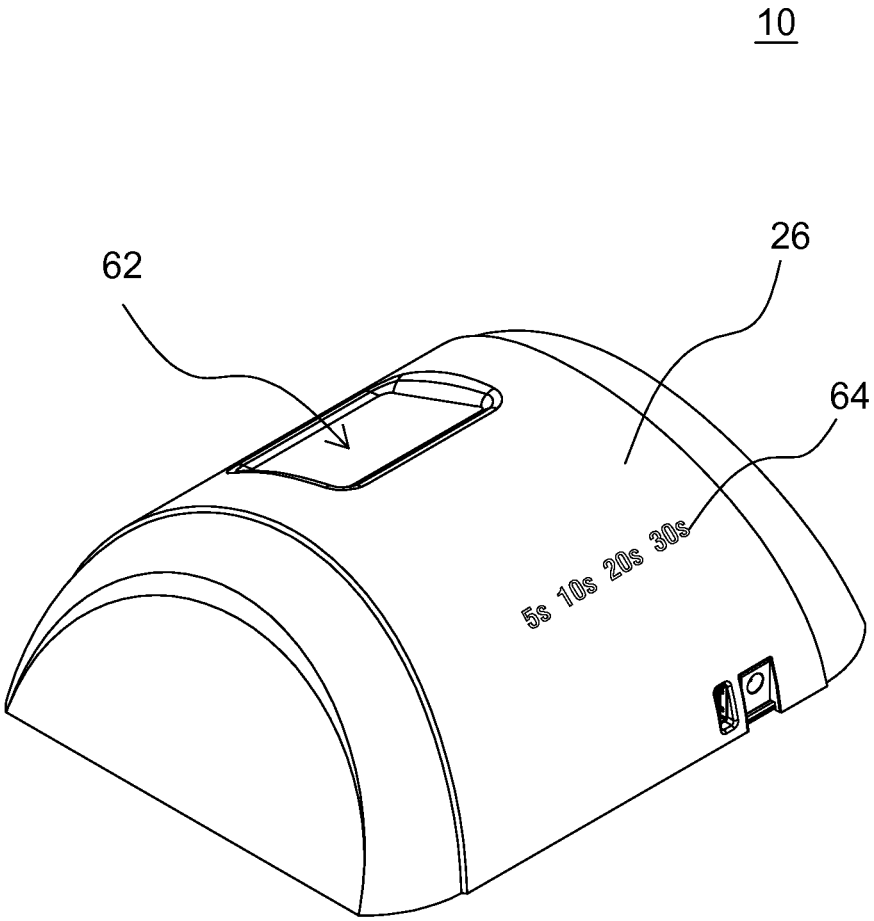
FIG. 7 schematically shows a nail lamp having a key module according to a second embodiment of the present invention.

In a second embodiment, the nail lamp does not adopt a touchscreen module but adopts an ordinary screen module to display information. Via the communication module and the memory module, the beauty industry and the advertisement industry can display their information on the screen module. Refer to FIG. 7. A screen module is disposed on the front side of the outer housing 26 to display dynamic or static information. The source of the information has been described above and will not repeat herein. A key module 64, such as capacitive touchscreen keys 64, is disposed on the rear side of the outer housing 26 and electrically connected with the control module 24 (shown in FIG. 1). The nail artist or user may use the key module 64 to select the operation duration of the LED module 22 (shown in FIG. 1 and FIG. 2).

In the second embodiment, the control module 24 further includes a light emitting module control unit and a screen module control unit. The light emitting module control unit and the light emitting module 20 are electrically connected with the capacitive touchscreen keys 64. The touchscreen module control unit is electrically connected with the screen module. In one embodiment, the light emitting module control unit and the screen control unit are integrated into one circuit module. However, the present invention does not limit that the light emitting module control unit and the screen control unit must be integrated into a circuit module. In another embodiment, the light emitting module control unit and the screen control unit are independent units and fabricated into different circuit modules.

In the second embodiment, the screen module includes a bracket and a screen fixedly installed in an accommodation space of the bracket. The assembly method and structure have been described in the abovementioned embodiment and will not repeat herein.

Figure 8:
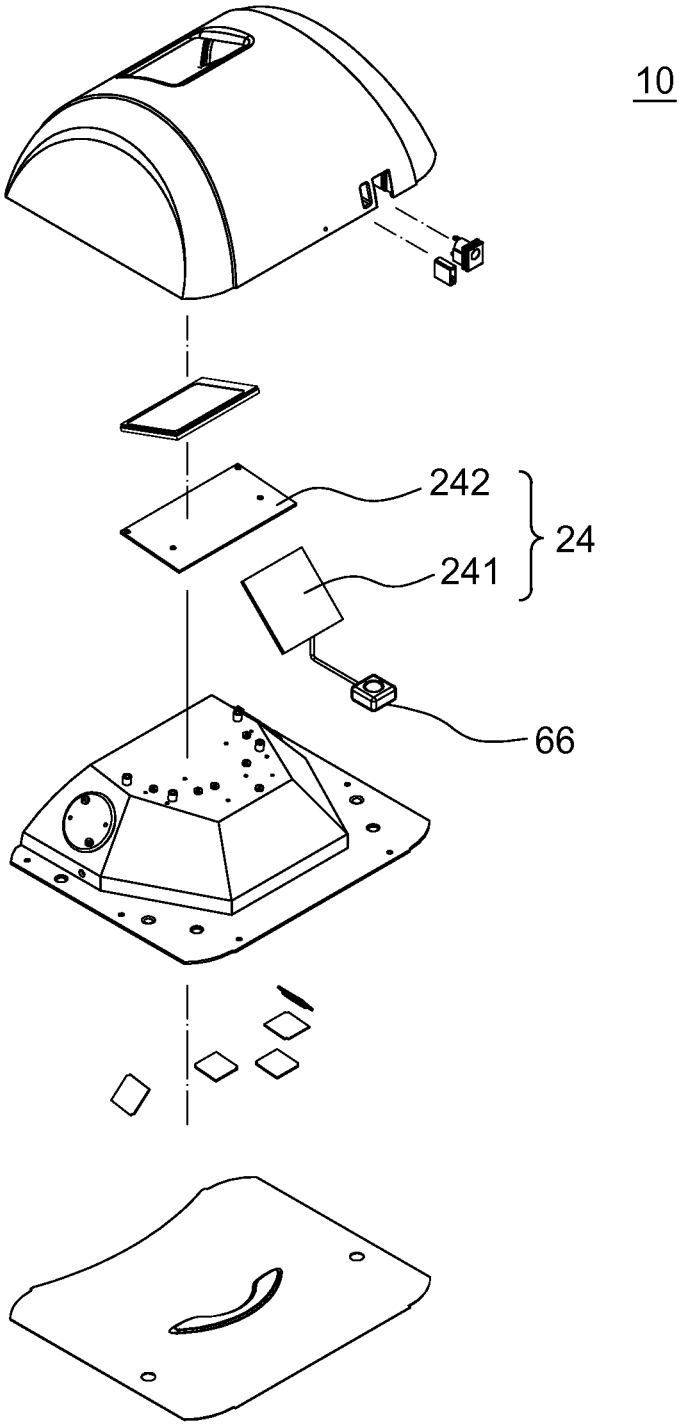
FIG. 8 is an exploded view schematically showing a nail lamp according to a third embodiment of the present invention.
Figure 9:
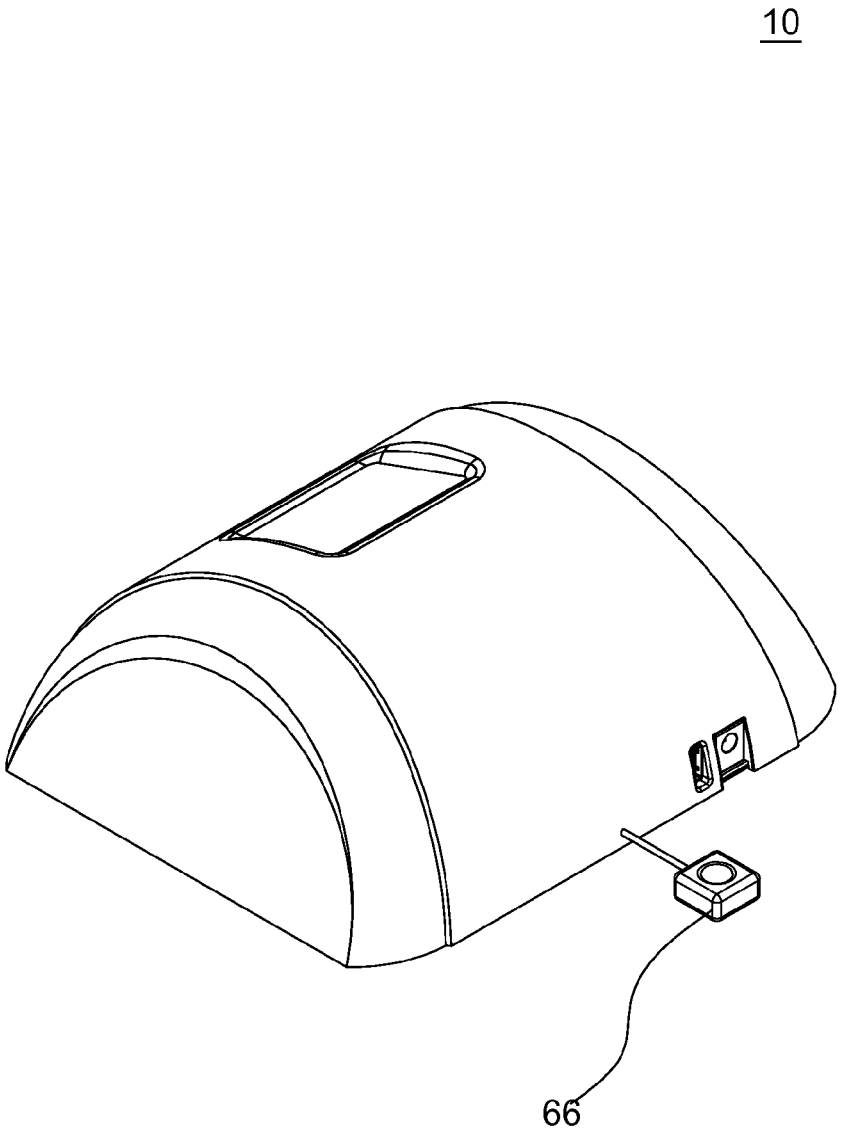
FIG. 9 schematically shows the structure of the nail lamp shown in FIG. 8.

FIG. 8 is an exploded view schematically showing a nail lamp according to a third embodiment of the present invention. FIG. 9 is a perspective view schematically showing the structure of the nail lamp shown in FIG. 8. The embodiment shown in FIG. 8 and FIG. 9 is different from the embodiment shown in FIG. 1 in that the control module 24 is divided into two independent units, i.e. the light emitting module control unit 241 and the screen module control unit 242. Further, the light emitting module control unit 241 is electrically connected with an external light source controller 66, whereby the nail artist or user can use the light source controller 66 to select the operation duration of the LED module 22 (shown in FIG. 1 and FIG. 2).

Figure 10:
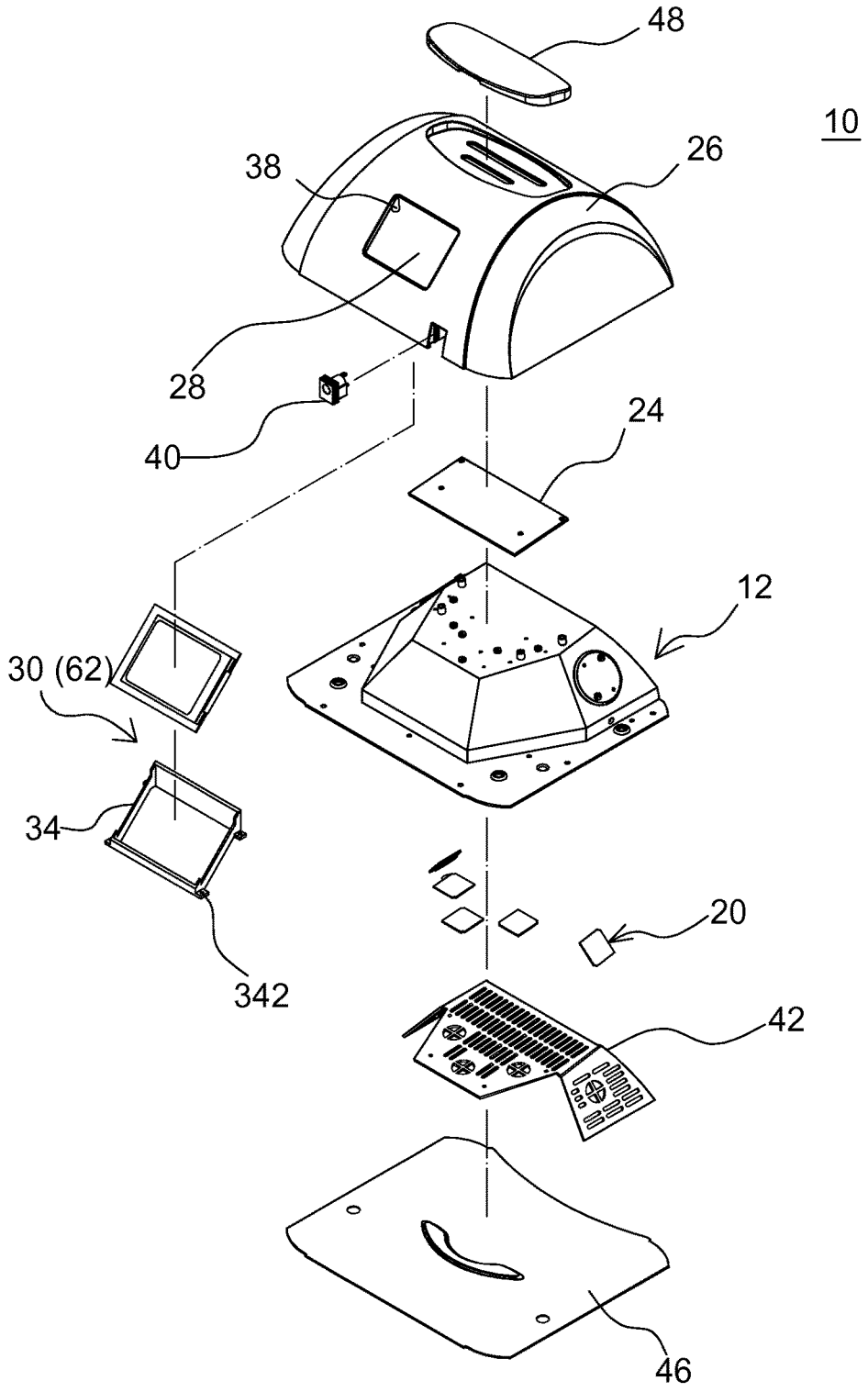
FIG. 10 is an exploded view schematically showing a nail lamp according to a fourth embodiment of the present invention.
Figure 11:
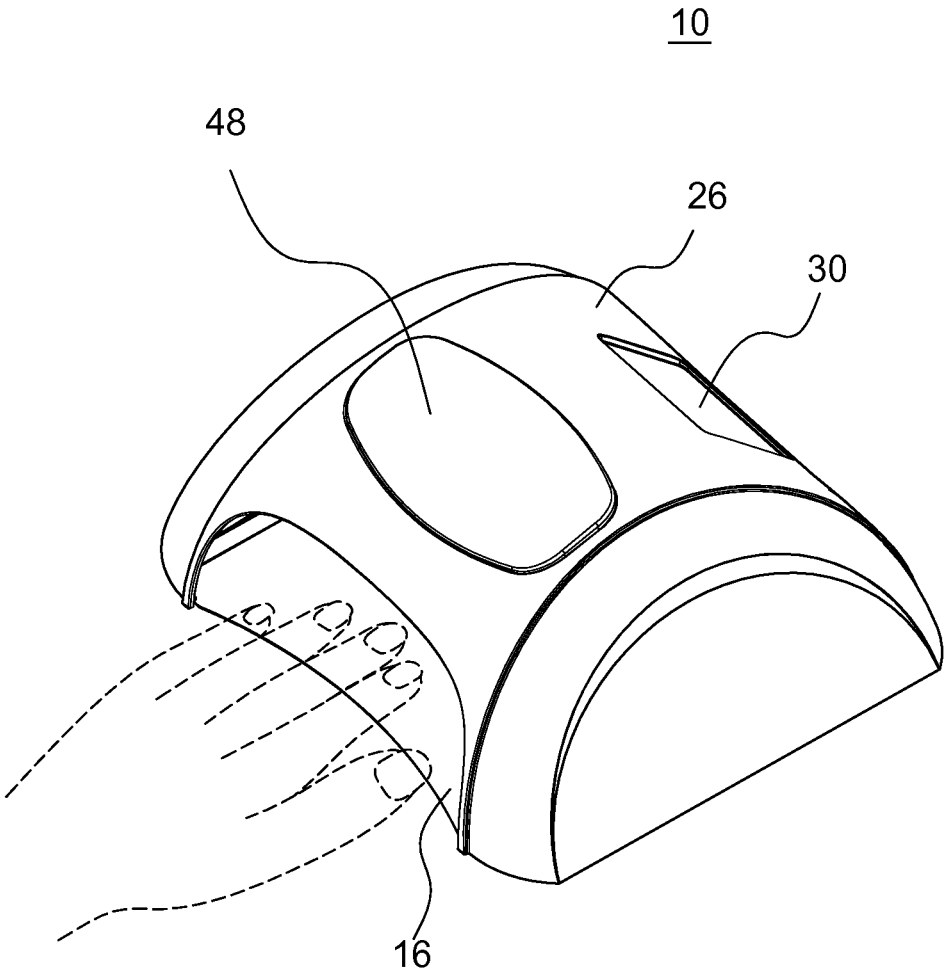
FIG. 11 schematically showing the structure of the nail lamp shown in FIG. 10.

FIG. 10 is an exploded view schematically showing a nail lamp according to a fourth embodiment of the present invention. FIG. 11 is a perspective view schematically showing the structure of the nail lamp shown in FIG. 10. In the fourth embodiment, the nail lamp 10 includes an inner casing 12, a light emitting module 20, a control module 24, an outer housing 26 and a touchscreen module 30 (or an ordinary screen module 62). Different from the first embodiment shown in FIG. 1, the fourth embodiment disposes the hole 28 on the rear side of the outer housing 26. The touchscreen module 30 or the screen module 62 is fixedly installed in the outer housing 26 and revealed by the hole 28. A plurality of screws (not shown in the drawings) is screwed through the fixing members 342 of the bracket 34 and into the threaded holes (not shown in the drawings) of a plurality of fixing pillars 38 disposed along the hole 28, whereby the bracket 34 of the touchscreen module 30 or the screen module 62 is fastened to the rim of the hole 28.

As shown in FIG. 10 and FIG. 11, the nail lamp 10 also includes a cushion 48 disposed on the top of the outer housing 26. The customer may place her/his hand on the cushion 48, manicured and decorated with nail art. Then, the customer places her/his hand in the inner chamber 16 for light-curing the nail gel. In one embodiment, the cushion 48 is made of a silicone rubber. In fourth embodiment, the nail lamp 10 further includes a communication module (not shown in the drawings) and a memory module (not shown in the drawings), which are electrically connected with the control module 24. The communication module is a Bluetooth module, a WiFi module, a USB module, a WiMAX module or a combination thereof. Via the communication module and the memory module, the beauty industry and the advertisement industry can display their information on the touchscreen module 30 or the screen module 62. In fourth embodiment, the nail lamp 10 further includes a DC (Direct Current) jack 40, which is electrically connected with the control module 24, whereby an external power source is connected with the DC jack 40 with a power cable to power the nail lamp 10.

Figure 12:
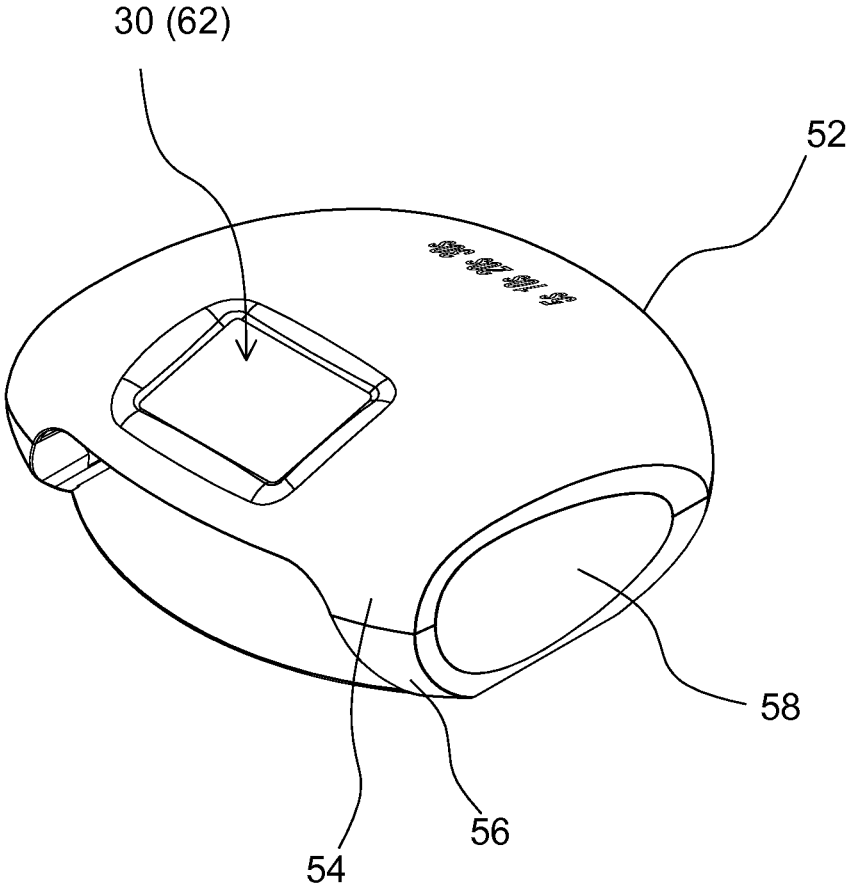
FIG. 12 schematically shows the structure of a nail lamp according to a fifth embodiment of the present invention.

FIG. 12 is a perspective view schematically showing the structure of a nail lamp according to a fifth embodiment of the present invention. The fifth embodiment is different from the abovementioned embodiments in that the outer housing 52 of the nail lamp 50 is not a one-piece element but includes an upper housing 54, a lower housing 56 and two side parts 58. The upper housing 54 is joined to the lower housing 56; the side parts 58 are respectively joined to the opposite sides of the assemblage of the upper housing 54 and the lower housing 56. The touchscreen module 30 or the screen module 62 is disposed on one side of the upper housing 54. In one embodiment, the two side parts 58 are made of a transparent material for a decorative effect.

The present invention is exempted from the conventional mechanical mechanism of keycaps and link levers but features a touchscreen module having an operating interface where an option menu of the operation durations of the LED modules is programmed beforehand, whereby the user can directly uses her/his finger to select an operation duration of the LED modules from the option menu. Therefore, the present invention increases the flexibility of selecting the operation duration of the light source of the nail lamp. The present invention further features a communication module through which the beauty industry and advertisement industry can display their information on the touchscreen module or the ordinary screen module, whereby the manicurists can periodically or aperiodically receive nail art-related information, and the customers can watch the videos or advertisements or read articles to enjoy themselves during nail manicuring and gel curing. Therefore, the present invention can overcome the conventional problem of the nail lamp, increase the function thereof and expand the application thereof.

Although the present invention has been explained in relation to its preferred embodiment, it is to be understood that other modifications and variation can be made without departing the spirit and scope of the invention as hereafter claimed.

What is claimed is:

1. A nail lamp comprising an inner casing including an inner shell and an inner chamber enclosed by the inner shell, wherein the inner chamber has at least one opening, and wherein the inner shell has an inner surface and an outer surface, and the inner surface faces the inner chamber;

at least one control module disposed on the inner shell;

a light emitting module disposed on the inner surface of the inner shell and electrically connected with the control module;

an outer housing hooding the inner casing and revealing the opening; and at least one touchscreen module disposed on the outer housing, having an operating interface exposed to exterior, and electrically connected with the control module.

2. The nail lamp according to claim 1, wherein the operating interface of the touchscreen module provides a function of selecting an operation duration of the light emitting module.

3. The nail lamp according to claim 1, wherein the operating interface of the touchscreen module displays dynamic information or static information.

4. The nail lamp according to claim 1 further comprising a communication module electrically connected with the control module, wherein the control module receives information through the communication module and displays the information on the touchscreen module.

5. The nail lamp according to claim 4, wherein the communication module is a Bluetooth module, a WiFi module, a WiMAX module, a USB module, or a combination thereof.

6. The nail lamp according to claim 4 further comprising a memory module electrically connected with the communication module and the control module and storing at least the information, which is transmitted through the communication module and is to be displayed on the touchscreen module.

7. The nail lamp according to claim 1, wherein the control module includes a light emitting module control unit electrically connected with the light emitting module and a touchscreen module control unit electrically connected with the touchscreen module.

8. The nail lamp according to claim 7 further comprising a light source controller electrically connected with the light emitting module or the light emitting module control unit.

9. The nail lamp according to claim 1 further comprising a USB connector disposed on the outer housing and electrically connected with the control module.

10. The nail lamp according to claim 1, wherein the outer housing has a hole for accommodating the touchscreen module.

11. The nail lamp according to claim 1 further comprising speaker elements electrically connected with the control module, and wherein the outer housing has a plurality of speaker holes.

12. A nail lamp comprising an inner casing including an inner shell and an inner chamber enclosed by the inner shell, wherein the inner chamber has at least one opening, and wherein the inner shell has an inner surface and an outer surface, and the inner surface faces the inner chamber;

at least one control module disposed on the inner shell;

a light emitting module disposed on the inner surface of the inner shell and electrically connected with the control module;

an outer housing hooding the inner casing and revealing the opening;

at least one screen module disposed on the outer housing and electrically connected with the control module; and a communication module electrically connected with the control module, wherein the control module receives information through the communication module and displays the information on the screen module.

13. The nail lamp according to claim 12, wherein the communication module is a Bluetooth module, a WiFi module, a WiMAX module, a USB module, or a combination thereof.

14. The nail lamp according to claim 12 further comprising a memory module electrically connected with the communication module and the control module and storing at least the information, which is transmitted through the communication module and is to be displayed on the screen module.

15. The nail lamp according to claim 12 further comprising a key module disposed on the outer housing, electrically connected with control module, and used to select an operation duration of the light emitting module.

16. The nail lamp according to claim 12, wherein the control module includes a light emitting module control unit electrically connected with the light emitting module and a screen module control unit electrically connected with the screen module.

17. The nail lamp according to claim 16 further comprising a light source controller electrically connected with the light emitting module or the light emitting module control unit.

18. The nail lamp according to claim 12 further comprising a USB connector disposed on the outer housing and electrically connected with the control module.

19. The nail lamp according to claim 12, wherein the outer housing has a hole for accommodating the screen module.

20. The nail lamp according to claim 12 further comprising speaker elements electrically connected with the control module, and wherein the outer housing has a plurality of speaker holes.

* * * * *